US011319703B2

(12) United States Patent
Nakagawa et al.

(10) Patent No.: US 11,319,703 B2
(45) Date of Patent: May 3, 2022

(54) ROOF FRAME STRUCTURE

(71) Applicant: SEKISUI HOUSE, LTD., Osaka (JP)

(72) Inventors: Takeshi Nakagawa, Osaka (JP); Kazumi Hijikata, Osaka (JP); Shinji Utsunomiya, Osaka (JP); Jun Mikuriya, Osaka (JP); Ryousuke Sato, Osaka (JP); Naruhiko Nakano, Osaka (JP); Shintarou Ichikawa, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 0 days.

(21) Appl. No.: 17/058,229

(22) PCT Filed: Dec. 27, 2019

(86) PCT No.: PCT/JP2019/051464
§ 371 (c)(1),
(2) Date: Nov. 24, 2020

(87) PCT Pub. No.: WO2020/145205
PCT Pub. Date: Jul. 16, 2020

(65) Prior Publication Data

US 2021/0189717 A1 Jun. 24, 2021

(30) Foreign Application Priority Data

Jan. 9, 2019 (JP) ..... JP2019-002189

(51) Int. Cl.
*E04B 1/58* (2006.01)
*E04B 7/02* (2006.01)
*E04B 1/24* (2006.01)

(52) U.S. Cl.
CPC ..... *E04B 1/58* (2013.01); *E04B 7/02* (2013.01); *E04B 2001/2415* (2013.01); *E04B 2001/2457* (2013.01)

(58) Field of Classification Search
CPC ..... E04B 1/58; E04B 7/02; E04B 2001/2415; E04B 1/38; E04B 1/2604; E04B 2001/2648; E04B 2001/2457
See application file for complete search history.

(56) References Cited

U.S. PATENT DOCUMENTS 1,511,652 A * 10/1924 Callahan ..... F16B 2/08 403/191
2,653,553 A * 9/1953 Jacobs ..... A01G 9/14 52/641

(Continued)

FOREIGN PATENT DOCUMENTS

DE 202011050816 U1 * 11/2011 ..... E04C 3/44
GB 540397 A 10/1941

(Continued)

OTHER PUBLICATIONS

Architectural Timber & Millwork, Inc., Tie Rod Trusses, http://atimber.com/tie-rod-trusses, (earliest available copy published on Jun. 16, 2016 obtained from https://web.archive.org/web/20160616085739/http://atimber.com/tie-rod-trusses (Year: 2016).*

*Primary Examiner* — Theodore V Adamos
(74) *Attorney, Agent, or Firm* — McClure, Qualey & Rodack, LLP

(57) ABSTRACT

A representative roof frame structure incorporates: paired wood sloping beams respectively extending from a ridge portion toward eaves on opposite sides from each other; a hanging portion hanging vertically downward from the ridge portion; and two steel braces respectively installed between lower faces of the sloping beams and side faces of a lower end of the hanging portion, wherein one end of each of the steel braces is pin-jointed to a beam-side fixing portion protruding from the lower face of the sloping beam, and the other end of each of the steel braces is pin-jointed to a (Continued)

hanging-portion-side fixing portion protruding from the side face of the lower end of the hanging portion.

4 Claims, 7 Drawing Sheets

(56) References Cited

U.S. PATENT DOCUMENTS 3,362,117 A * 1/1968 Raden ..... E04C 3/292 52/223.12
3,785,108 A * 1/1974 Satchell ..... E04C 3/11 52/645
4,161,088 A * 7/1979 Gugliotta ..... E04B 1/19 403/176
4,299,067 A * 11/1981 Bertschi ..... E04B 1/6162 403/296
5,217,317 A * 6/1993 Young ..... F16B 9/058 403/232.1
5,253,945 A * 10/1993 Hosokawa ..... E04B 1/2604 403/258
5,342,138 A * 8/1994 Saito ..... E04H 12/2261 403/189
5,438,811 A * 8/1995 Goya ..... E04B 1/2604 52/702
5,620,275 A * 4/1997 Novacek ..... E04B 1/2604 403/232.1
5,857,543 A * 1/1999 Shalders ..... E04G 11/50 182/179.1
5,881,514 A * 3/1999 Pryor ..... E04C 5/08 52/223.8
7,360,341 B2 * 4/2008 Jackson ..... E04G 11/50 52/645
2015/0184380 A1 * 7/2015 Yamamoto ..... E04C 3/02 52/634
2016/0289949 A1 * 10/2016 Okura ..... E04B 1/2604

FOREIGN PATENT DOCUMENTS

JP 1975-97219 U1 8/1975
JP 1990-272142 A 11/1990
JP 1990-304153 A 12/1990
JP 2001-152561 A 6/2001
JP 2002-97737 A 4/2002
JP 2013-133642 A 7/2013
JP 2014-139372 A 7/2014
JP 2007-36575 A 2/2017
JP 2017-36575 A 2/2017
JP 2017-66736 A 4/2017

* cited by examiner

ROOF FRAME STRUCTURE

TECHNICAL FIELD

The present invention relates to a roof frame structure that supports a roof of a building and particularly relates to a roof frame structure that forms a roof having a slope.

BACKGROUND ART

Conventionally, as a roof frame structure that supports a roof of a building, a truss structure in which members are pin-jointed at nodes and the respective members are assembled in a triangular shape may have been used in some cases (see Patent Literatures 1 and 2, for example). The truss structure is effective at forming a large space without columns because even a long wood beam, for example, can be supported only at opposite ends.

Among the roof frame structures using such truss structures, there is a roof frame structure using a structure in which wood sloping beams are assembled in a triangular shape and stabilized by pulling lower ends of the sloping beams toward each other by use of braces (tension rods) (see Patent Literature 3). This structure has advantages that the structure is lightweight, tension adjustment is easy, and assembly work can be simplified. In the structure in Patent Literature 3, in order to prevent detachment of the braces, each of the braces is inserted through a through hole formed through the lower end of each of the sloping beams and a brace end portion is secured to a terminal member at an exit of the through hole.

CITATION LIST

Patent Literature

Patent Literature 1: JP H02-272142 A

Patent Literature 2: JP 2013-133642 A

Patent Literature 3: JP 2017-66736 A

SUMMARY OF THE INVENTION

Technical Problems

However, because the end portion of each of the steel braces is inserted through the through hole in the roof frame structure in Patent Literature 3, the portion of the steel brace sticking out of the through hole bends if axial directions of the through hole and the steel brace are displaced at all from each other. Therefore, construction precision of the sloping beams and working precision of the through hole need to be high. Moreover, a load is concentrated on the end portion of the steel brace due to displacement or the like of the through hole under a weight of roofing material. Furthermore, because the long steel braces are horizontally stringed across a ceiling of the building, the roof frame structure has a problem with a degree of freedom in design of an attic and the ceiling such as a difficulty in improving design properties of an exposed structure ceiling.

Therefore, it is an object of the present invention to provide a roof frame structure with which a degree of freedom in design of a ceiling can be increased and in which concentration of loads on jointed end portions of steel braces can be avoided.

Solution to Problems

A roof frame structure according to the present invention comprising:

paired wood sloping beams respectively extending from a ridge portion toward eaves on opposite sides from each other;

a hanging portion hanging vertically downward from the ridge portion; and two steel braces respectively installed between lower faces of the sloping beams and side faces of a lower end of the hanging portion, wherein one end of each of the steel braces is pin-jointed to a beam-side fixing portion protruding from the lower face of the sloping beam, and the other end of each of the steel braces is pin-jointed to a hanging-portion-side fixing portion protruding from the side face of the lower end of the hanging portion.

The roof frame structure according to the present invention, wherein the beam-side fixing portion protrudes from a lower face of an end portion on an eaves side of each of the sloping beams.

The roof frame structure according to the present invention, wherein the beam-side fixing portion protrudes from a lower face of a middle portion in a length direction of each of the sloping beams.

The roof frame structure according to the present invention, wherein the hanging-portion-side fixing portions are formed at higher positions than the beam-side fixing portions.

The roof frame structure according to the present invention, wherein the hanging-portion-side fixing portions are formed at lower positions than the beam-side fixing portions.

The roof frame structure according to the present invention, wherein ridge portion beam hangers are respectively fixed to opposite side faces of an upper end of the hanging portion, and upper ends of the sloping beams are respectively fixed to the ridge portion beam hangers.

The roof frame structure according to the present invention, wherein each of the beam-side fixing portions has an upper portion where a tenon pipe to be inserted and fixed into a mortise formed in the lower face of each of the sloping beams is formed and a lower portion where a beam-side plate formed to be exposed from the sloping beam and provided with a receiving hole is formed, and the roof frame structure further comprises:

brace end plates respectively formed at end portions of the steel braces and provided with fixing holes; and joint members each of which is inserted into the receiving hole and the fixing hole to joint each of the beam-side plates and each of the brace end plates to allow the beam-side plate and the brace end plate to rotate.

Advantageous Effects of Invention

According to the roof frame structure of the present invention, because the opposite ends of the steel braces are pin-jointed, bending moment is not generated at each of the jointed end portions of the steel braces, which keeps the roof frame structure straight. By using the steel braces as bottom chords, it is possible to form the relatively lightweight roof frame structure that is easy to assemble. Moreover, by providing the two separate steel braces on opposite sides of the hanging portion, it is possible to increase a degree of freedom in layout of the steel braces to thereby improve design properties of a ceiling.

According to the roof frame structure of the present invention, because the beam-side fixing portion protrudes from the lower face of the end portion on the eaves side of each of the sloping beams, it is possible to form a large truss structure having the entire sloping beams as top chords and the steel braces as the bottom chords to thereby provide the stable roof frame structure.

According to the roof frame structure of the present invention, because the beam-side fixing portion protrudes from the lower face of the middle portion in the length direction of each of the sloping beams, it is possible to form a truss structure in a relatively small triangular shape to thereby improve a degree of freedom in design of a ceiling.

According to the roof frame structure of the present invention, because the hanging-portion-side fixing portions are formed at the higher positions than the beam-side fixing portions, the two steel braces are disposed in a mountain shape to slop upward toward the hanging portion. Therefore, a ceiling looks high when the ceiling is looked up at from a space formed below the roof frame structure, which reduces a feeling of oppression produced by the steel braces.

According to the roof frame structure of the present invention, because the hanging-portion-side fixing portions are formed at the lower positions than the beam-side fixing portions, the two steel braces are disposed in a valley shape to slop downward toward the hanging portion. Therefore, because the steel braces are sloping in different directions from the sloping beams when the steel braces are looked up at from a space formed below the roof frame structure, a ceiling looks more varied than when the steel braces are disposed horizontally.

According to the roof frame structure of the present invention, because the ridge portion beam hangers are respectively fixed to opposite side faces of the upper end of the hanging portion to fix upper ends of the sloping beams, it is possible to joint the upper ends of the hanging portion and the paired sloping beams. Thus, it is possible to construct the roof frame structure by assembling the paired sloping beams, the hanging portion, and the two steel braces to form each of the truss structures on the ground and then hoisting the respective truss structures by use of a crane or the like, which reduces work in high places and improves ease of construction.

According to the roof frame structure of the present invention, each of the beam-side fixing portions is a fixing bracket having the upper portion where the tenon pipe to be inserted and fixed into the mortise formed in the lower face of each of the sloping beams is formed and the lower portion where the beam-side plate formed to be exposed from the sloping beam and provided with the receiving hole is formed and each of the fixing brackets and each of the brace end plates formed at the end portions of the steel braces and provided with the fixing holes are jointed to be able to rotate by use of a joint member. Therefore, it is possible to pin-joint each of the wood sloping beams and each of the steel braces such that the sloping beam and the steel brace can rotate.

DESCRIPTION OF EMBODIMENTS

First Embodiment

A roof frame structure 1 in a first embodiment of the present invention will be described below with reference to the respective figures. The roof frame structure 1 in the first embodiment is a structure for a building such as an auditorium and a hall requiring a large interior space without columns and is a roof frame structure 1 for a building with a gable roof. The building may be a home such as an apartment building or a house. By reducing columns in an interior where the columns are provided, it is possible to freely lay out partition walls and the like.

Figure 1:
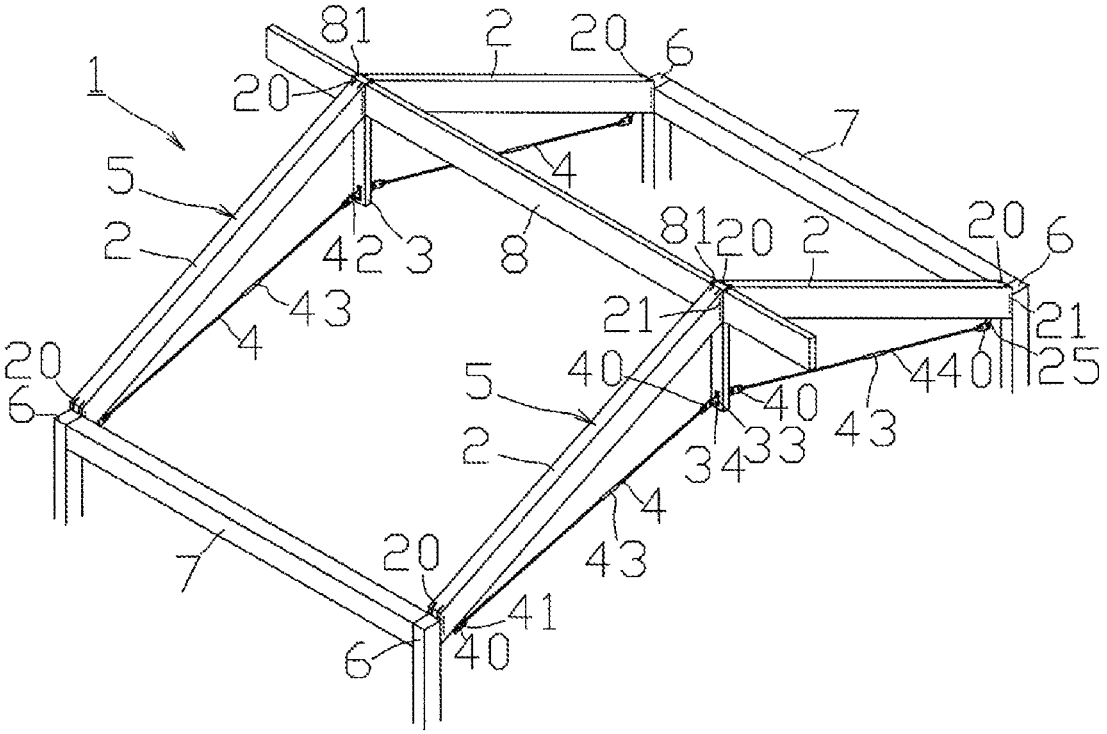
FIG. 1 is a simplified perspective view of an overall structure of a roof frame structure in a first embodiment.

As shown in FIG. 1, the roof frame structure 1 includes paired sloping beams 2 respectively extending from a ridge portion toward eaves on opposite sides from each other, a hanging portion 3 hanging vertically downward from the ridge portion, and two steel braces 4 respectively installed between lower faces of the sloping beams 2 and lower ends of side faces of the hanging portion 3 and a plurality of truss structures 5 each of which is formed by the sloping beams 2, the hanging portion 3, and the steel braces 4 are installed at intervals of 2 m, for example, between column tops 6 of columns formed on sides of eaves or between wall plates 7. In the present embodiment, each of the truss structures 5 is installed between the column top 6 on the one eaves side and the column top 6 on the other eaves side. Because a distance between the column on the one eaves side and the column on the other eaves side is 10 m and no vertical members are provided between the two columns, it is possible to secure a large space below the roof frame structure 1.

Figure 2:
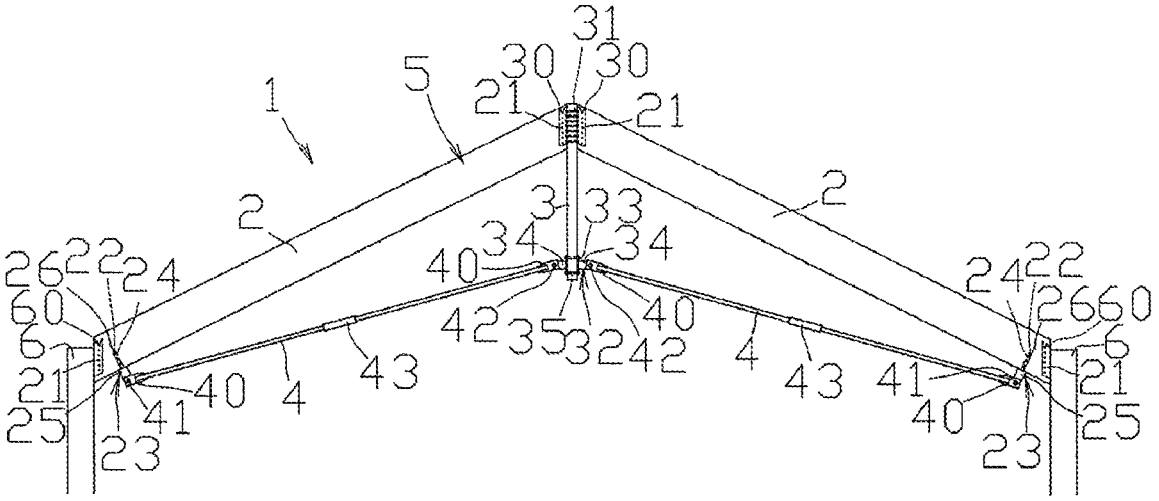
FIG. 2 is a simplified front view of the overall structure of the roof frame structure in the first embodiment.
Figure 4:
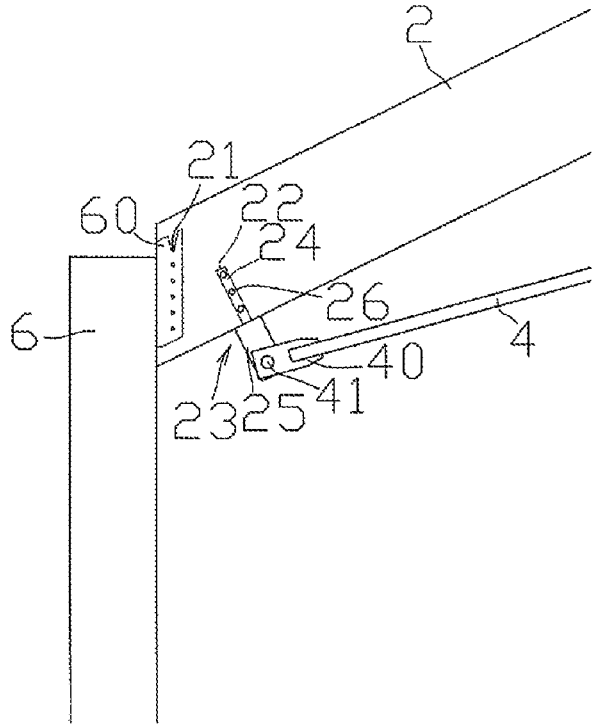
FIG. 4 is an enlarged view of a structure of an end portion on an eaves side of a sloping beam of the roof frame structure in the first embodiment.
Figure 5:
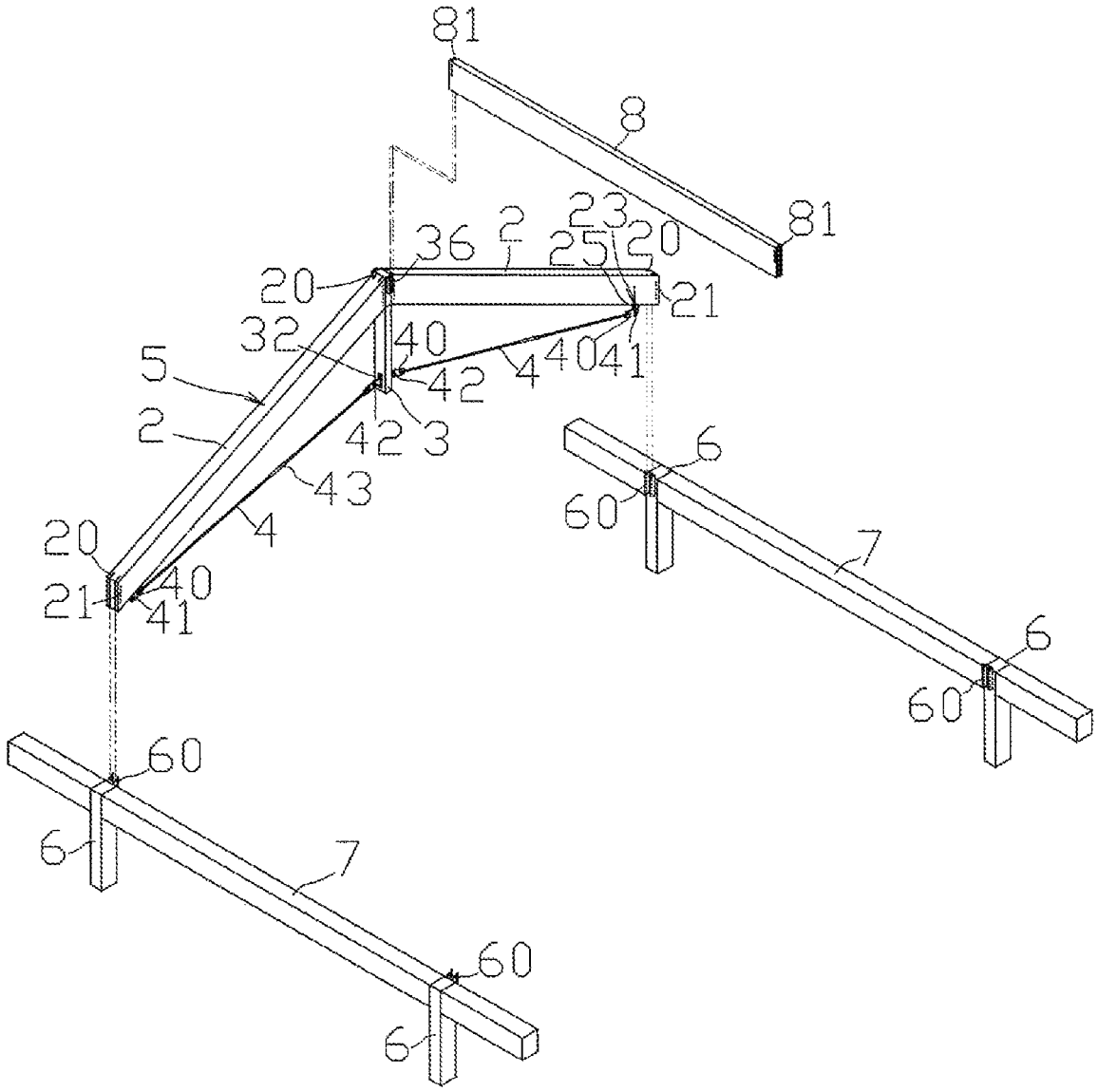
FIG. 5 is a simplified perspective view of an example of a construction method of the roof frame structure in the first embodiment.

The sloping beams 2 are wood beams and vertical slit grooves 20 are respectively formed in an end face on a ridge side and an end face on the eaves side of each of the sloping beams 2. Into the slit grooves 20, a ridge portion beam hanger 30 and an eaves portion beam hanger 60 can be inserted, respectively. Beam fixing holes 21 are formed to pass through each of the sloping beams 2 at ridge-side and eaves-side end portions of side faces of the sloping beam 2 and the beam fixing holes 21 are orthogonal to the slit grooves 20. As shown in FIGS. 2 and 4, the end portion on the eaves side of each of the sloping beams 2 is jointed to the column top 6 on the eaves side. To put it concretely, in a state in which the eaves portion beam hanger 60 fixed to the column top 6 is inserted into the slit groove 20 formed in the end portion on the eaves side of each of the sloping beams 2, drift pins are inserted into the beam fixing holes 21 to fix the sloping beam 2 and the eaves portion beam hanger 60 to thereby joint the end portion on the eaves side of the sloping beam 2 and the column top 6.

A mortise 22 is formed in a lower face on the eaves side of each of the sloping beams 2. A tenon pipe 24 formed at a beam-side fixing portion 23 is inserted into the mortise 22 and the tenon pipe 24 is fixed to the sloping beam 2 by use of horizontal pins 26 passing through the sloping beam 2. The beam-side fixing portion 23 includes the tenon pipe 24 and a beam-side plate 25 integral with the tenon pipe 24. A through hole is formed to pass through the beam-side plate 25.

Figure 3:
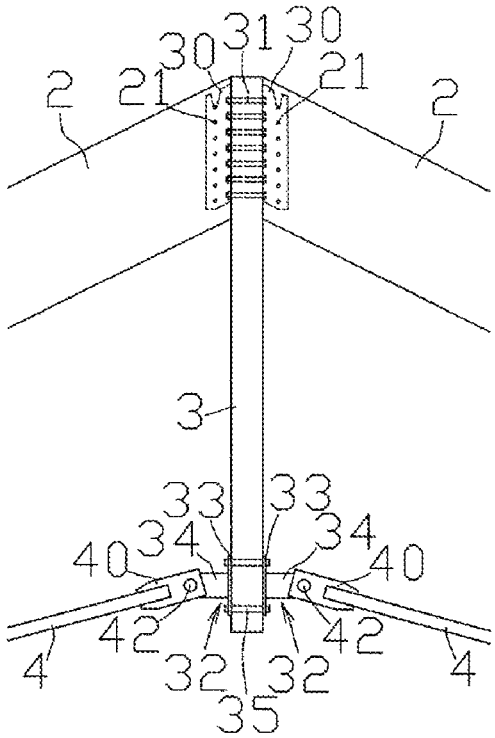
FIG. 3 is an enlarged view of a structure including a hanging portion of the roof frame structure in the first embodiment.

The hanging portion 3 is in a shape of a wood quadrilateral prism. A lower end of the hanging portion 3 is disposed at a higher position than lower ends of the sloping beams 2. As shown in FIGS. 2 and 3, to side faces on an upper end side of the hanging portion 3, ridge portion beam hangers 30 are fixed by use of bolts and nuts 31. In a state in which the ridge portion beam hangers 30 are inserted into the slit grooves 20 formed in the end portions on the ridge side of the sloping beams 2, drift pins inserted into the beam fixing holes 21 in the sloping beams 2 fix the sloping beams 2 and the ridge portion beam hangers 30 to thereby joint the side faces on the upper end side of the hanging portion 3 and the ridge-side end portions of the sloping beams 2.

As shown in FIG. 3, on the opposite side faces on a lower end side of the hanging portion 3, hanging-portion-side fixing portions 32 are formed, respectively. Each of the hanging-portion-side fixing portions 32 includes a base plate 33 fixed to the side face of the lower end of the hanging portion 3 and a protruding plate 34 protruding from the base plate 33 and the base plates 33 on opposite sides are fixed by use of bolts and nuts 35 passing through the hanging portion 3. A through hole is formed in each of the protruding plates 34. The protruding plates 34 are disposed at higher positions than beam-side plates 25 protruding from the lower faces on the eaves sides of the sloping beams 2.

Each of the steel braces 4 is a steel wire and has brace end plates 40 respectively formed at opposite ends. A fixing hole is formed to pass through each of the brace end plates 40. The brace end plate 40 on one end side of the steel brace 4 is fixed to the beam-side plate 25 formed on the lower face of each of the sloping beams 2 and the brace end plate 40 on the other end side is fixed to the protruding plate 34 formed on the side face of the lower end of the hanging portion 3. To put it concretely, on the one end side of the steel brace 4, the through hole formed in the beam-side plate 25 and the fixing hole in the brace end plate 40 are superimposed on each other and the beam-side plate 25 and the brace end plate 40 are pin-jointed by use of a joint member 41 formed by a bolt and a nut to be able to swing. On the other end side of the steel brace 4, the through hole formed in the protruding plate 34 and the fixing hole formed in the brace end plate 40 are superimposed on each other and the protruding plate 34 and the brace end plate 40 are pin-jointed by use of a hanging portion joint member 42 formed by a bolt and a nut to be able to swing. A turnbuckle 43 that adjusts tension is provided at a center in a length direction of each of the steel braces 4.

The brace end plates 40 formed at the opposite ends of each of the steel braces 4 are respectively pin-jointed to the beam-side plate 25 and the protruding plate 34 higher than the beam-side plate 25 and, as a result, the two steel braces 4 are disposed to slope upward toward the hanging portion 3 and disposed to be higher as the steel braces 4 become closer to a center of the roof frame structure 1.

By using the steel braces 4 as bottom chords of the truss structure 5, it is possible to form the relatively lightweight roof frame structure 1 that is easy to assemble. Moreover, by providing the two separate steel braces 4 on opposite sides of the hanging portion 3, it is possible to increase a degree of freedom in layout of the steel braces 4 to thereby improve design properties of a ceiling.

Because the beam-side plates 25 of the beam-side fixing portions 23 are protruding from the lower faces of the eaves-side end portions of the sloping beams 2, it is possible to form the large truss structure 5 having the entire sloping beams 2 as top chords and the steel braces 4 as the bottom chords to thereby provide the stable roof frame structure 1. Because the hanging-portion-side fixing portions 32 are formed at higher positions than the beam-side fixing portions 23, the two steel braces 4 are disposed in a mountain shape to slop upward toward the hanging portion 3. Therefore, the ceiling looks high when the ceiling is looked up at from the space formed below the roof frame structure 1, which reduces a feeling of oppression produced by the steel braces 4.

In the roof frame structure 1, the truss structures 5 each of which is formed by the sloping beams 2, the hanging portion 3, and the steel braces 4 are installed with a 2-m pitch. A ridge board 8 is installed between upper end portions of the adjacent hanging portions 3 of the truss structures 5. Ridge board hangers 36 are respectively fixed to upper ends of opposed faces of the adjacent hanging portions 3 and the ridge board 8 is fixed by use of drift pins and jointed to the hanging portions 3 in a state in which the ridge board hangers 36 are inserted into slit grooves 20 formed in end portions of the ridge board 8.

To construct the roof frame structure 1 formed as described above, first, the truss structure 5 is completed on the ground. In a process of completing the truss structure 5, first, the two sloping beams 2 are respectively jointed to the side faces on the upper end side of the hanging portion 3. To put it concretely, the ridge portion beam hangers 30 are fixed to the side faces of the upper end of the hanging portion 3 by use of the bolts and nuts, the ridge portion beam hangers 30 are inserted into the slit grooves 20 formed in the end portions on the ridge side of the sloping beams 2, and the drift pins are inserted into the beam fixing holes 21 in the sloping beams 2 to thereby joint the ridge-side end portions of the sloping beams 2 and the side faces on the upper end side of the hanging portion 3. At this time, to the different side faces of the hanging portion 3 from the side faces to which the ridge portion beam hangers 30 are fixed, the ridge board hangers 36 are fixed, respectively.

Next, the tenon pipes 24 of the beam-side fixing portions 23 are inserted into the mortises 22 formed in the lower faces on the eaves sides of the sloping beams 2 and the horizontal pins 26 are inserted to pass through the sloping beams 2 to thereby fix the beam-side fixing portions 23 such that the beam-side plates 25 protrude from the lower faces of the sloping beams 2. The hanging-portion-side fixing portions 32 are fixed to the side faces of on the lower end side of the hanging portion 3 by use of the bolts and nuts passing through the hanging portion 3 such that the protruding plates 34 protrude from the opposite side faces on the lower end side of the hanging portion 3.

Then, the beam-side plates 25 and the brace end plates 40 of the steel braces 4 are pin-jointed by use of the joint members 41 and the protruding plates 34 and the brace end plates 40 of the steel braces 4 are pin-jointed by use of the hanging portion joint members 42, which completes the truss structure 5.

Next, the truss structure 5 is hoisted by use of a crane (not shown), the eaves portion beam hangers 60 fixed to the column tops 6 are inserted into the slit grooves 20 formed in the end faces on the eaves sides of the sloping beams 2, the drift pins are inserted into the beam fixing holes 21 to joint the eaves-side side faces of the sloping beams 2 to the column tops 6, and the truss structure 5 is installed between the column tops 6 in this way.

After the plurality of truss structures 5 are installed between the column tops 6, the ridge board 8 is installed between the upper ends of the hanging portions 3 of the adjacent truss structures 5. To put it concretely, the drift pins are inserted to joint the ridge board 8 between the hanging portions 3 in a state in which the ridge board hangers 36 respectively fixed to the upper ends of the opposed faces of the adjacent hanging portions 3 are inserted into slit grooves 80 formed in the end portions of the ridge board 8, which completes the roof frame structure 1.

If this construction procedure in which the truss structure 5 is assembled in advance near the ground, hoisted by use of the crane, and installed between the column tops 6 is employed, it is possible to reduce work in high places to thereby improve safety in construction work of the roof frame structure 1.

A vertical load applied to the roof frame structure 1 from roofing material and the like is transferred to the paired sloping beams 2 as axial compressive forces that try to displace the end portions on the eaves sides of the sloping beams 2 away from each other. However, the compressive forces are balanced by pulling the end portions on the eaves sides of the sloping beams 2 toward the hanging portion 3 by use of the two steel braces 4, which prevents displacement of the sloping beams 2. The roof frame structure 1 can be constructed by only installing the truss structure 5 between the column tops 6 of the two columns at a relatively long distance from each other and without providing column members between the columns and a large space without columns can be provided below the roof frame structure 1. Because the opposite ends of the steel braces 4 are pin-jointed in the roof frame structure 1 in the first embodiment, bending moment is not generated at each of the jointed end portions of the steel braces 4, which keeps the roof frame structure 1 straight. Because the roof frame structure is formed by the pin-jointed truss structures 5, only loads in compression or tensile directions which are directions of fibers of wood are applied and loads in shear directions are not applied to the wood sloping beams 2 and hanging portions 3 and only loads in tensile directions are applied to the steel braces 4. Thus, it is unnecessary to reinforce a lower portion of the roof frame structure 1 with the column members or the like.

Second Embodiment

As described above, because the two steel braces 4 are disposed in the mountain shape to slop upward toward the hanging portion 3 in the roof frame structure 1, the ceiling looks high when the ceiling is looked up at from the space formed below the roof frame structure 1, which reduces the feeling of oppression produced by the steel braces 4. However, embodiments of the roof frame structure 1 according to the present invention are not limited to this embodiment. Next, a roof frame structure 1 in a second embodiment will be described. Structures similar to those of the roof frame structure 1 in the first embodiment will be provided with the same reference signs and will not be described.

Figure 6:
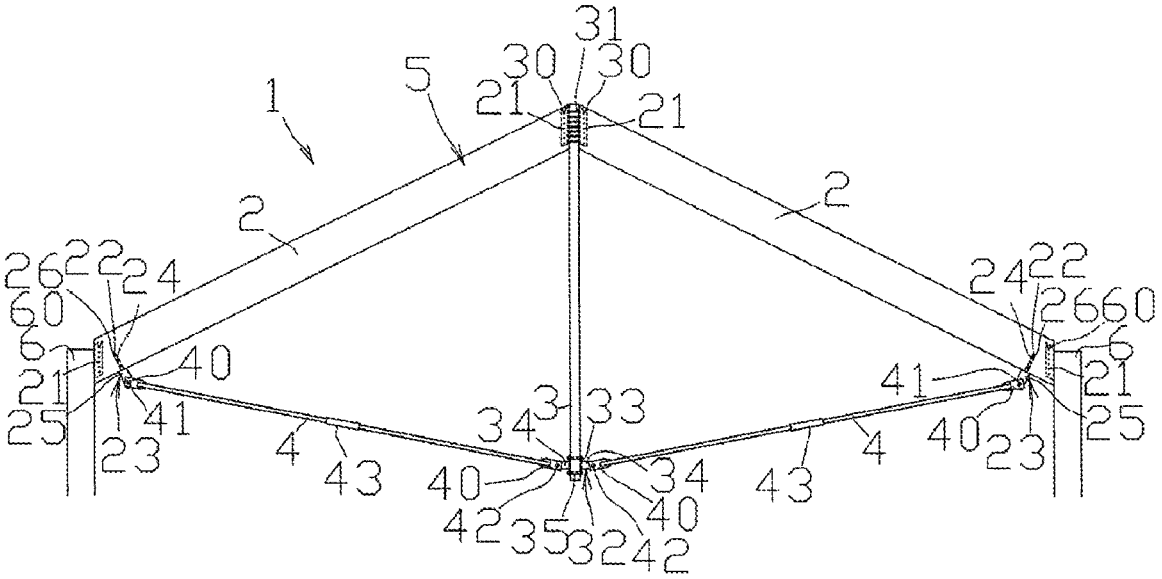
FIG. 6 is a simplified front view of an overall structure of a roof frame structure in a second embodiment.

As shown in FIG. 6, the roof frame structure 1 in the second embodiment includes paired sloping beams 2 respectively extending from a ridge portion toward eaves on opposite sides from each other, a hanging portion 3 hanging vertically downward from the ridge portion, and two steel braces 4 respectively installed between lower faces of the sloping beams 2 and side faces of a lower end of the hanging portion 3 and a plurality of truss structures 5 each of which is formed by the sloping beams 2, the hanging portion 3, and the steel braces 4 are installed at intervals of 2 m, for example, between column tops 6 of columns formed on eaves sides or between wall plates 7. Structures of the sloping beams 2 are similar to those in the first embodiment.

The hanging portion 3 is in a shape of a wood quadrilateral prism and a lower end of the hanging portion 3 is disposed at a lower position than lower ends of the sloping beams 2. As in the first embodiment, to side faces on an upper end side of the hanging portion 3, ridge portion beam hangers 30 are fixed by use of bolts and nuts 31 and end portions on a ridge side of the sloping beams 2 are jointed. On the opposite side faces on a lower end side of the hanging portion 3, hanging-portion-side fixing portions 32 similar to those in the first embodiment are formed, respectively. Protruding plates 34 of the hanging-portion-side fixing portions 32 are disposed at lower positions than beam-side plates 25 protruding from the lower faces on the eaves sides of the sloping beams 2.

Each of the steel braces 4 has brace end plates 40 respectively formed at opposite ends as in the first embodiment. The brace end plate 40 on one end side of the steel brace 4 is pin-jointed to the beam-side plate 25 formed on the lower face of each of the sloping beams 2 and the brace end plate 40 on the other end side is pin-jointed to the protruding plate 34 formed on the side face of the lower end of the hanging portion 3. The brace end plates 40 formed at the opposite ends of each of the steel braces 4 are respectively pin-jointed to the beam-side plate 25 and the protruding plate 34 lower than the beam-side plate 25 and, as a result, the two steel braces 4 are disposed to slope downward toward the hanging portion 3 and disposed to be lower as the steel braces 4 become closer to a center of the roof frame structure 1.

Because the hanging-portion-side fixing portions 32 are formed at lower positions than the beam-side fixing portions 23 in the roof frame structure 1 in the present embodiment, the two steel braces 4 are disposed in a valley shape to slop downward toward the hanging portion 3. Therefore, because the steel braces 4 are sloping in different directions from the sloping beams 2 when the steel braces 4 are looked up at from a space formed below the roof frame structure 1, a ceiling looks more varied than when the steel braces 4 are disposed horizontally.

Third Embodiment

Figure 7:
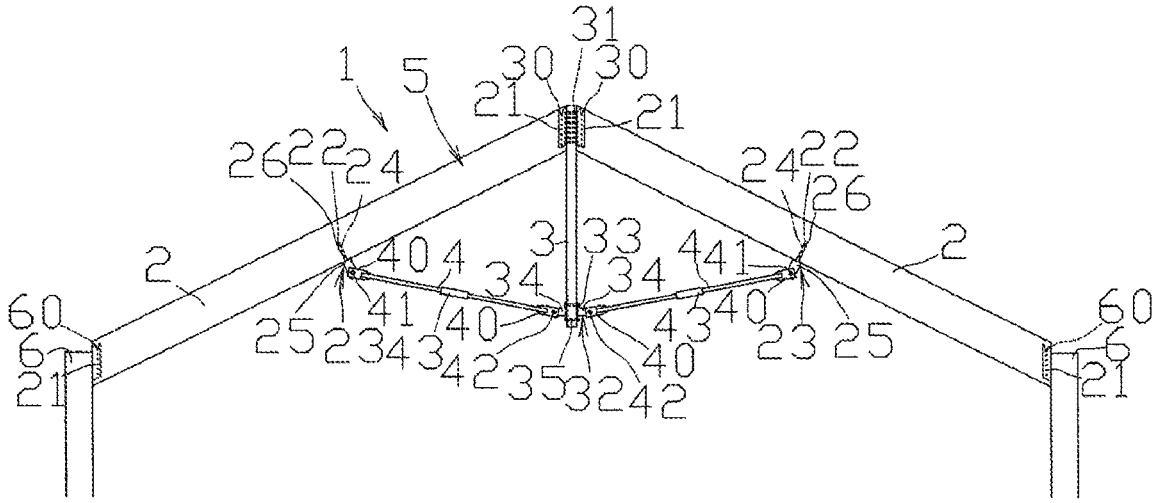
FIG. 7 is a simplified front view of an overall structure of a roof frame structure in a third embodiment.

Next, a roof frame structure 1 in a third embodiment will be described with reference to FIG. 7. Structures similar to those in the first or second embodiment will be provided with the same reference signs and will not be described. In the roof frame structure 1 in the third embodiment, a mortise 22 in each of sloping beams 2 is formed in a lower face of a middle portion in a length direction of the sloping beam 2, a tenon pipe 24 formed at a beam-side fixing portion 23 is inserted into the mortise 22, and the beam-side fixing portion 23 is fixed to the sloping beam 2 by use of horizontal pins 26. The beam-side fixing portion 23 includes the tenon pipe 24 and a beam-side plate 25 integral with the tenon pipe 24. Here, the middle portion in the length direction of each of the sloping beams 2 refers to a portion of the sloping beam 2 excluding an eaves-side or ridge-side end portion. For example, the middle portion is a middle portion when the sloping beam 2 is divided into three portions in the length direction.

A hanging portion 3 has a similar structure to that in the first embodiment and a lower end of the hanging portion 3 is disposed at a higher position than lower ends of the sloping beams 2 and the lower end of the hanging portion 3 is disposed at a lower position than the middle portions of the sloping beams 2. On the opposite side faces on a lower end side of the hanging portion 3, hanging-portion-side fixing portions 32 similar to those in the first embodiment are formed, respectively. Protruding plates 34 of the hanging-portion-side fixing portions 32 are disposed at lower positions than the beam-side plates 25 protruding from the lower faces of the middle portions in the length directions of the sloping beams 2.

Each of steel braces 4 has brace end plates 40 respectively formed at opposite ends as in the first embodiment. The brace end plate 40 on one end side of the steel brace 4 is pin-jointed to the beam-side plate 25 formed on the lower face of each of the sloping beams 2 and the brace end plate 40 on the other end side is pin-jointed to the protruding plate 34 formed on a lower end of the side face of the hanging portion 3. The brace end plates 40 formed at the opposite ends of each of the steel braces 4 are respectively pin-jointed to the beam-side plate 25 and the protruding plate 34 lower than the beam-side plate 25 and, as a result, the two steel braces 4 are disposed to slope downward toward the hanging portion 3 and disposed to be lower as the steel braces 4 become closer to a center of the roof frame structure 1.

Because the beam-side fixing portions 23 protrude from the lower faces of the middle portions in the length directions of the sloping beams 2, a triangle of a truss structure 5 can be made a relatively small triangle, which reduces a feeling of oppression produced by a ceiling due to the stringed steel braces 4 to thereby improve a degree of freedom in design of the ceiling.

Although the roof frame structure 1 in each of the first to third embodiments is in a shape of a gable roof having the sloping beams 2 sloping at the same angles, the sloping beams 2 may have different inclination angles or lengths if tensile forces applied from the steel braces 4 to the hanging-portion-side fixing portions 32 on the side faces of the lower end of the hanging portion 3 are balanced.

Embodiments of the present invention are not limited to those described above and it is needless to say that the embodiments can be changed as appropriate without departing from the spirit of the present invention.

INDUSTRIAL APPLICABILITY

The roof frame structure 1 according to the present invention is suitable for a building such as an auditorium and a hall requiring a large space.

LIST OF REFERENCE SIGNS

1 a roof frame structure
2 sloping beams
3 hanging portion
4 steel braces
23 beam-side fixing portion
32 hanging-portion-side fixing portions
40 brace end plates
41 joint member

The invention claimed is:

1. A roof frame structure comprising:

paired wood sloping beams respectively extending from a ridge portion toward eaves on opposite sides from each other;

a hanging portion hanging vertically downward from the ridge portion; and two steel braces respectively installed between lower faces of the sloping beams and side faces of a lower end of the hanging portion, wherein one end of each of the steel braces is pin-jointed to a beam-side fixing portion protruding from the lower face of the sloping beam, and the other end of each of the steel braces is pin-jointed to a hanging-portion-side fixing portion protruding from the side face of the lower end of the hanging portion, the hanging portion forms a wooden quadrilateral prism, the hanging-portion-side fixing portions are formed at higher positions than the beam-side fixing portions, ridge portion beam hangers are respectively fixed to opposite side faces of an upper end of the hanging portion, and upper ends of the sloping beams are respectively fixed to the ridge portion beam hangers.

2. The roof frame structure according to claim 1, wherein the beam-side fixing portion protrudes from a lower face of an end portion on an eaves side of each of the sloping beams.

3. The roof frame structure according to claim 1, wherein the beam-side fixing portion protrudes from a lower face of a middle portion in a length direction of each of the sloping beams.

4. The roof frame structure according to claim 1, wherein:

each of the beam-side fixing portions has an upper portion where a tenon pipe to be inserted and fixed into a mortise formed in the lower face of each of the sloping beams is formed and a lower portion where a beam-side plate formed to be exposed from the sloping beam and provided with a receiving hole is formed, and the roof frame structure further comprises:

brace end plates respectively formed at end portions of the steel braces and provided with fixing holes; and joint members each of which is inserted into the receiving hole and the fixing hole to joint each of the beam-side plates and each of the brace end plates to allow the beam-side plate and the brace end plate to rotate.

* * * * *